US009599102B2

(12) United States Patent
Kuznetsov

(10) Patent No.: US 9,599,102 B2
(45) Date of Patent: Mar. 21, 2017

(54) PIEZOELECTRIC PUMP UNIT

(71) Applicant: Andrey Leonidovich Kuznetsov, Moscow (RU)

(72) Inventor: Andrey Leonidovich Kuznetsov, Moscow (RU)

( * ) Notice: Subject to any disclaimer, the term of this patent is extended or adjusted under 35 U.S.C. 154(b) by 814 days.

(21) Appl. No.: 13/954,996

(22) Filed: Jul. 31, 2013

(65) Prior Publication Data

US 2014/0037471 A1 Feb. 6, 2014

(30) Foreign Application Priority Data

Aug. 2, 2012 (RU) ..... 2012133197

(51) Int. Cl.
*F04B 17/03* (2006.01)
*F04B 17/00* (2006.01)
*F04B 47/06* (2006.01)

(52) U.S. Cl.
CPC ..... *F04B 17/003* (2013.01); *F04B 47/06* (2013.01)

(58) Field of Classification Search
CPC ..... F04B 17/003; F04B 47/06
See application file for complete search history.

(56) References Cited

U.S. PATENT DOCUMENTS 3,598,506 A * 8/1971 O'Neill ..... F04B 43/10 310/328
4,408,832 A * 10/1983 Hartman ..... H02N 2/023 310/328
2006/0198742 A1 9/2006 DiFoggio et al.

FOREIGN PATENT DOCUMENTS

EA 011817 B1 6/2009
RU 2452872 1/2012

OTHER PUBLICATIONS

A. Suleman, S. Burns, D. Waechter, "Design and Modeling of an Electrostrictive Inchworm Actuator", Mechatronics, IEEE/ASME Transactions on (vol. 14, Issue: 5 ), Jun. 2004, pp. 567-586.*

* cited by examiner

*Primary Examiner* — Matthew F Desanto

(57) ABSTRACT

The piezoelectric pump unit consists of a housing, a piezo anchor, located in the housing, a displacer, located at the front of the housing. The piezo anchor and the displacer are connected. The piezo anchor consists of a rear piezoelectric clamp section, of a piezoelectric extender section and of a front piezoelectric clamp section, connected in series. At least one slider is introduced in the piezoelectric extender section between its front and rear ends. Electric pulses accessing at sections from a control station cause said sections to become fixed alternately inside the housing. Under the effect of electric pulses, the piezoelectric extender section moves the displacer step-by-step in one direction.

2 Claims, 2 Drawing Sheets

PIEZOELECTRIC PUMP UNIT

BACKGROUND OF THE INVENTION

The invention relates to devices for pumping of fluids, and may be used in the industry, transport and households at pumping of liquids, other incompressible and compressible fluids, and at producing of oil from wells.

The closest analogue of the claimed technical solution is a piezoelectric pump unit for pumping fluids described in the patent RU2452872, published Jun. 10, 2012, Int'l Class 8 F04B 9/00. The pump comprises a housing, piezo anchor, located in the housing and a displacer, located in the front part of the housing. The piezo anchor and the displacer are connected. The piezo anchor consists of a rear piezoelectric clamp section, a piezoelectric extender section that is movable relative to the housing in the direction of changing its length, and a front piezoelectric clamp section, connected in series. The piezoelectric clamp sections and the piezoelectric extender section are made with material capable to change its length at connecting an electric potential to it, for example of piezoceramic material.

Electrical pulses supplied to the piezoelectric clamp sections cause them to lock in the housing one-by-one. The piezoelectric extender section provides periodical movement of the clamp section that is not fixed in the housing at one step under influence of an electrical pulse supplied to it. This causes a step-by-step movement of the displacer relative to the housing in one direction.

Pumping unit supply largely depends on the length of the piezoelectric extender section. However, the considerable length of that section it not only increases in length due to incoming electrical pulses, but may also bend. This is a so-called loss of stability under longitudinal compression. When excluding the loss of stability of a long piezoelectric extender section, it is possible to increase the supply of piezoelectric pump unit significantly.

SUMMARY OF THE INVENTION

The problem to be solved by the present technical solution is to extend the limits of applicability of the piezoelectric pump unit.

The technical result achieved by implementing the invention is to increase the supply of the piezoelectric pump unit.

For solution of the problem with achievement of the technical result in the known piezoelectric pump unit, comprising a housing, a piezo anchor, located in the housing, a displacer, located in the front of the housing, the piezo anchor and the displacer are connected, the piezo anchor containing a rear piezoelectric clamp section, a piezoelectric extender section that is movable relative to the housing in the direction of variation of the piezoelectric extender section length, and a front piezoelectric clamp section, connected in series; according to the invention claimed at least one slider introduced in the piezoelectric extender section between its front and rear ends, the slider contacts the housing from inside.

Due to the new design of the piezoelectric extender section and an additional connection between it and the housing it is possible to increase the supply of piezoelectric pump unit.

BRIEF DESCRIPTION OF THE DRAWINGS

The abovementioned advantages of the invention and its features are explained in the preferred embodiment with reference to the drawings.

DETAILED DESCRIPTION OF THE PREFERRED EMBODIMENT

Figure 1:
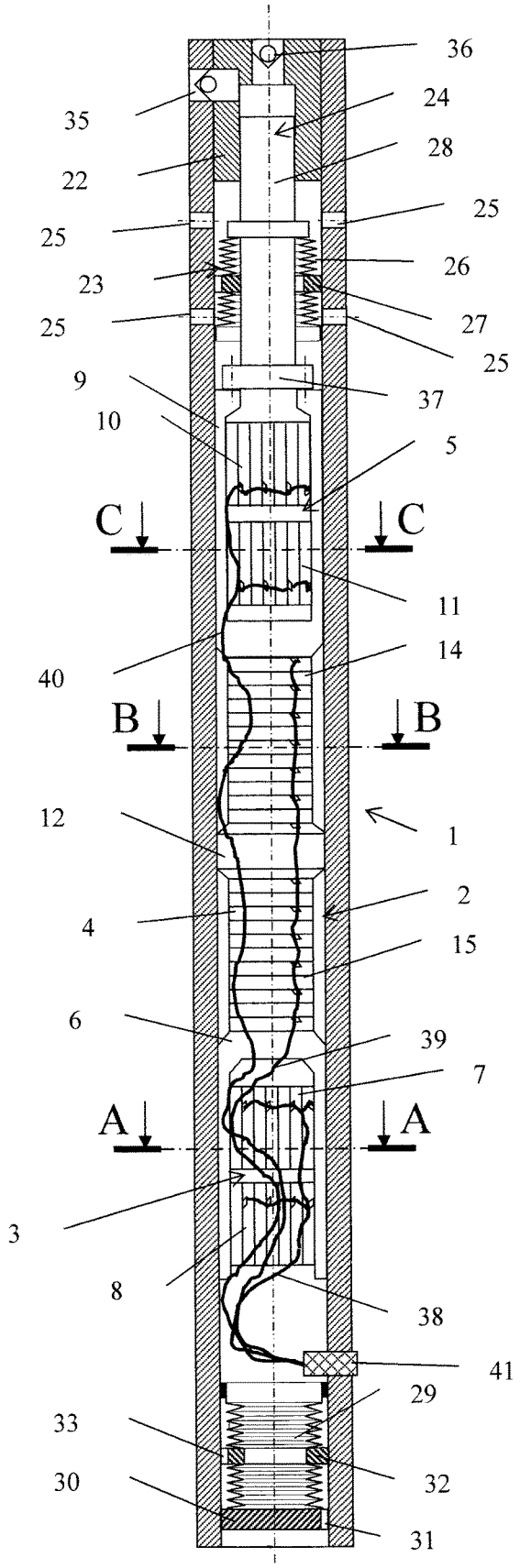
FIG. 1 shows a piezoelectric pump unit with a longitudinal cut view of the housing.

The piezoelectric pump unit (FIGS. 1 and 4) comprises a hollow housing 1 and a piezo anchor 2 disposed therein. The piezo anchor 2 comprises a rear piezoelectric clamp section 3, a piezoelectric extender section 4 and a front piezoelectric clamp section 5, connected in series. The rear piezoelectric clamp section 3 comprises a bracket 6 and piezo stacks 7 and 8. The bracket 6 is a U-shaped part composed of two longitudinal bars and a transverse bar connecting them. Piezoelectric actuators, 7 and 8, named as "piezoelectric stacks", or "piezo stacks" are disposed between the longitudinal bars of the bracket 6 (FIG. 1, 2). The direction of the piezo stacks 7 and 8 length variation at supplying voltage to them is perpendicular to the longitudinal bars of the bracket 6.

The front piezoelectric clamp section 5 comprises a bracket 9 and piezo stacks 10 and 11. The bracket 9 is a U-shaped part composed of two longitudinal bars and a transverse bar connecting them. Piezo stacks 10 and 11 are disposed between the longitudinal bars of the bracket 9 (FIG. 1, 2). The direction of the piezo stacks 10 and 11 length variation at supplying voltage to them is perpendicular to the longitudinal bars of the bracket 9.

The transverse bar of the U-shaped bracket 6 of the rear piezoelectric clamp section 3 faces forward, and the transverse bar of the U-shaped bracket 9 of the front piezoelectric clamp section 5 faces backward.

The rear end of the piezoelectric extender section 4 is connected to the transverse bar of the U-shaped bracket 6 of the rear piezoelectric clamp section 3 and its front end connected to the transverse bar of the U-shaped front bracket 9 of the front piezoelectric clamp section 5. All the longitudinal bars of the U-shaped brackets 6 and 9 are parallel.

Depending on the required pump unit pressure the required number of the piezo stacks in the piezoelectric clamp sections 3 and 5 is comprised in the pump unit.

In the piezoelectric extender section 4 the slider 12 is provided (FIGS. 1, 4) between its front and rear ends that contacts the housing from inside. For the long piezoelectric extender section 4 there may be few sliders evenly distributed along the section. Contacting the inner walls of the housing 1 under compressive loads, the sliders do not allow the piezoelectric section 4 to bend.

The pump housing 1 may be partially or completely filled with the liquid polyethylsiloxane. For flowing of liquid while piezo anchor 2 is moving the holes 13 in the slider 12 (FIG. 4) are provided thus connecting the internal housing space from back of the slider with the internal space in front of the slider.

There is a piezo stack 14 (FIGS. 1, 3) between the front end of the piezoelectric extender section 3 and the slider 12. The piezo stack 15 (FIG. 1) is provided between the slider 12 and the rear end of the piezoelectric extender section. The piezo stacks may be provided between the sliders (for a construction with few slides) also.

There is a rod 16 (FIGS. 3, 4) in the piezoelectric extender section. It extends from the rear end of the piezoelectric extender section 4 (FIG. 1) to its front end. The transverse bar of the U-shaped bracket 6 (FIG. 4) of the rear piezoelectric clamp section 3 and the rod 16 are connected with a threaded connection. The transverse bar of the U-shaped bracket 9 (FIG. 1) of the front piezoelectric clamp section 5 and the rod 16 are connected with a threaded connection. Direction of the piezo stack 14 and 15 length variation at coming an electric voltage to them coincides with the direction of the rod 16.

Figure 3:
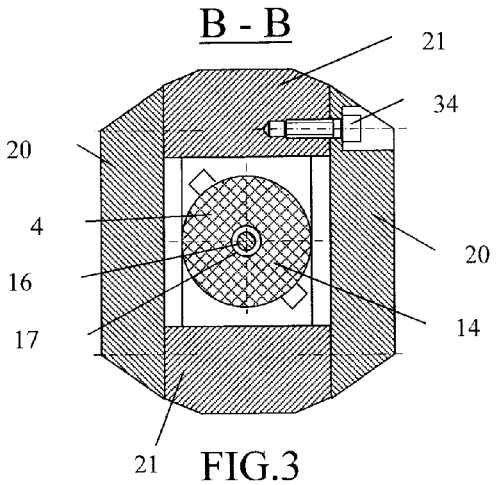
FIG. 3—cross-sectional cut view of the piezoelectric pump unit at the piezoelectric extender section region (wires not shown)
Figure 4:
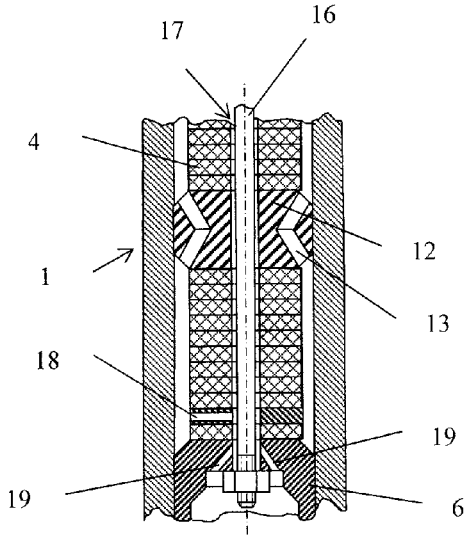
FIG. 4—longitudinal cut view of the extender section.

There is a foramen 17 inside the piezoelectric extender section 4 (FIGS. 3, 4) that connects the internal space of the housing near the rear end of the piezoelectric extender section with an internal space of the housing near the front end of the piezoelectric extender section, intended for additional cooling of the piezo stacks 14 and 15, as well as for possible flow of liquid through the piezoelectric extender section 4 (FIGS. 3, 4). There is a clearance between the piezoelectric extender section 4 and the rod 16 disposed inside it. The foramen 17 is formed by a clearance between the rod 16 and the piezoelectric extender section 4. In the piezoelectric extender section 4 near its rear end there is a hole 18 connecting the foramen 17 with the internal space of the housing. Also in the rear piezoelectric clamp section 3 in the bracket 6 holes 19 are provided connecting the foramen 17 with the internal space of the housing. In the piezoelectric extender section 4 near its front end there is a hole, connecting the foramen 17 with the internal space of the housing. Also in the front piezoelectric clamp section 5 in the bracket 9 holes 19 are provided connecting the foramen 17 with the internal space of the housing.

Figure 2:
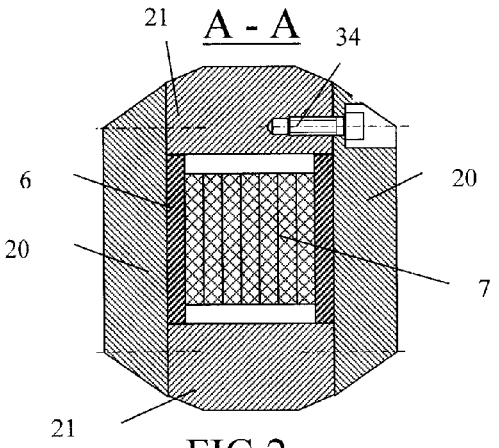
FIG. 2—cross-sectional cut view of the piezoelectric pump unit at the rear piezoelectric clamp section region (wires not shown)
Figure 5:
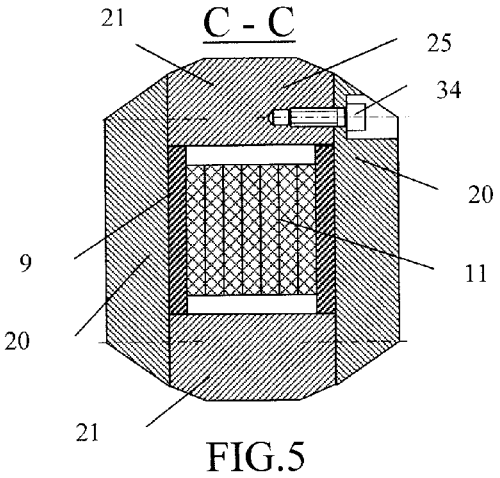
FIG. 5—cross-sectional cut view of the piezoelectric pump unit at the front piezoelectric clamp section region (wires not shown).

The housing 1 of the pumping unit comprises two friction members 20 (FIGS. 2, 3 and 5) and the two lateral members 21. The friction members 20 are arranged parallel, one member is opposite another member. The lateral members 21 are located between them forming an internal space, the front opening of the internal space and the rear opening of the internal space. The piezo anchor 2 (FIG. 1) is located in the internal space. The longitudinal bars of the U-shaped brackets 6 and 9 of the rear and front piezoelectric clamp sections 3 and 5, respectively, contact the friction members 20 from inside. The displacer housing 22 is a part of the housing 1. The displacer housing 22 is connected to the front opening of the internal space. In the absence of liquid in the housing 1 or at partial filling of it by liquid the rear opening of the housing can be hermetically closed by a cover.

The seal section 23 (FIG. 1) isolates the internal space of the housing 1, wherein the piezoelectric sections 3, 4 and 5 move, from the pumped medium.

The seal section is made of a liquid impermeable thin material having a peripheral edge and a hole. The seal section peripheral edge sealingly fixed in the front part of the housing 1 around its internal space opening. The displacer 24 locates in the hole of the seal section. The edge of the seal section hole is sealingly fixed around the displacer 24, sealing the front internal space of the housing where the piezoelectric sections are. The through openings 25 are provided in the housing 1 between the fixing place of the seal section peripheral edge and the contact area of the displacer 24 with the housing 1.

The seal section may be made as a flexible membrane or a diaphragm or a bellows tube. The bellows tube as a seal section can be of a membrane type 26 (FIG. 1) or with rounded vertices and depressions on its cross-section. At least one slider 27 of a ring shape between the front and rear ends of the seal section 23 is provided additionally. The slider 27 is coaxially and sealingly connected to the seal section 23, more exactly to its bellows tubes. The slider 27 contacts the displacer 24.

As a displacer 24 the piston 28 may be used connected to the piezo anchor 2 (in the design shown in FIG. 1 it is connected to the bracket 9). The seal section may be performed as a gland seal, hermetically fixed to the housing 1 in the region between the front piezoelectric clamp section 5 and piston 28. The rear portion of the piston may slide in the gland seal.

An opening may be provided in the housing 1 that connects an outer surface of the housing and the internal space of the housing, where the piezoelectric sections are. At that a compensator is introduced into the design of the unit made of a liquid impermeable thin material. The peripheral edge of the compensator is sealed around the opening of the housing 1 to seal the interior of the housing, where the piezoelectric sections 3, 4 and 5 are. The housing 1 is partially or completely filled with liquid in that design.

A compensator 29 is provided additionally in the pump unit design shown in FIG. 1. It is made of a liquid impermeable thin material such as stainless steel or brass. The peripheral edge of the compensator is sealed around the rear opening of the internal space of the housing. The housing is partially or completely filled with liquid at that such as liquid polyethylsiloxane. The compensator may be a flexible membrane or a diaphragm or a bellows tube.

The bellows tube may be used of a type with rounded vertices and depressions on its cross-section or of a membrane type, as it is shown in the compensator 29 in the FIG. 1. The unattached edge of the bellows tube compensator is hermetically attached to the cover 30. The cover 30 contacts the housing 1 from inside. There is an opening 31 in the peripheral portion of the cover 30. The opening 31 connects the outer surface of the compensator bellows tube with the outer space.

A slider 32 between the front and rear ends of the compensator 29 is provided additionally, it is of a ring shape. The slider 32 is coaxially and sealingly connected to the compensator 29, to its bellows tubes. The slider 32 contacts the housing 1 from inside. In the peripheral portion of the slider ring 32 there is an opening 33, connecting the outer surface of compensator bellows tube in front of the slider 32 with the outer surface of the bellows tube of the compensator 32 in the back of the slider.

Parts assembling of the housing 1 is done by bolts 34 (FIGS. 2, 3, 5) or by threaded studs. They may be sealed with seal rings and/or welding by tin, tin solder, silver solder, copper-phosphorus brazing, brass.

To provide the cyclic operation of the pump unit an intake valve 35 and an exhaust valve 36 are provided. The valves are located in the front part of the housing 1 before the displacer 24.

The displacer 24 (or the piston 28) is connected to the piezo anchor 2. In the design shown in the FIG. 1 it is connected to the front end of the piezoelectric extender section 4 (the bracket 9) by means of the elastic member 37. The elastic member 37 reduces vibrations generated during the linear movement of the piezo anchor 2 and transmitted to the displacer 24. The elastic member 37 is made of material ensuring acceptable damping of vibrations due to its elasticity and damping properties. The elastic member 37 may be designed as a spring, such as a leaf spring. It is possible to perform the design in the form of a helical spring or in the form of a rocker made of elastic and/or damping material.

An electric wire 38 is connected to the piezo stacks 7 and 8 of the rear piezoelectric clamp section 3. An electrical wire 39 is connected to the piezoelectric extender section 4. An electric wire 40 is connected to the piezo stacks 10 and 11 of the front piezoelectric clamp section 5. The electric wires 38, 39 and 40 are connected to the electrical connector 41. The electrical connector 41 may be placed in the housing, providing connection of an electrical power cable from outside of the unit.

The power cable connected from the outside of the unit may be performed with four wires: three power wires and a common wire. Also the power cable may be configured as a shielded three-wire cable, each wire should have its independent shield in this case. Also, there may be additional wires in the cable for feedback sensors and telemetry devices.

In the first phase of discharge the rear piezoelectric clamp section 3 is in the clamped state. That means that the U-shaped bracket 6 is pressing onto the housing 1 from inside in the transverse direction. It takes place due to supplying an electric voltage from the electric connector 41 through the wire 38 to piezo stacks 7 and 8. The front piezoelectric clamp section 5 in this phase of discharge is in a free state, the clamping effort is minimal or is absent at all between the bracket 9 and the plates of the housing 1. At the same time there is no gap. A gap means the incorrect settings, fault, excessive temperature or wear of the pump unit. Presence of the gap cause additional vibration, lowering of pressure and possible closest failure of the unit.

In the second phase of discharge an electrical voltage comes through the wire 39 to the piezoelectric extender section 4, and the section increases its length. The front clamp section 5 connected to it moves forward at a short distance against the force of the compression rod 16.

In the third phase of discharge an electrical voltage from the wire 40 comes to the front piezoelectric clamp section 5, to its piezo stacks 10 and 11, and the bracket 9 begins to press from inside on the housing 1. In other words, the section 5 turns into the clamped state. At the same time an electric voltage from the wire 38 does not come to the rear piezoelectric clamp section 3, and it turns into the free state, not pressing from inside on the housing 1, or pressing with the least possible force. However the gap between the housing and the bracket 9 is also missing in this case.

In the fourth phase of discharge an electrical voltage does not come any more through the wire 39 to the piezoelectric extender section 4. The section 4 turns into the free state, that is, its length is decreased. The rear piezoelectric clamp section 3 moves forwardly for a short distance from the force of the compression rod 16 at that phase. At the end of the fourth discharge phase an electric voltage does not come to the front piezoelectric clamp section 5 from the wire 40, and it turns to the free state, that means it does not press from inside on the housing 1 any more.

Such a phases rotation provides stepping displacement of piezoelectric sections 3, 4 and 5 forwardly. Since the displacer 24 (piston 28) is connected with the moving piezo anchor 2 by an elastic element 37, then filling liquid from space between the piston 28 and the housing of the piston 22 moves with it forwardly. The intake valve 35 is closed and the outlet valve 36 is opened. Fluid flows out of the piezoelectric pump unit with pressure through it.

The phases sequence is repeated at discharge many times until the the fluid displacer 24 (piston 28) reaches its extreme front position. The moment when the extreme front position is reached is determined from curve of the electric current changing in the wire 39. Also this moment can be monitored by means of piezoelectric sections position feedback sensor or a displacer position feedback sensor.

Sucking starts after the displacer of the working fluid 24 (piston 28) reaches its extreme front position. In the first phase of suction the rear piezoelectric clamp section 3 of the piezoelectric pump 1 is in a free state, that is, the U-shaped bracket 6 does not press on the housing 1 from inside, or it presses with a minimal effort.

In the second phase of suction the piezoelectric extender section 4 increases its length. The rear clamp section 3 is moved backward at a short distance overcoming force of the compression rod 16.

In the third phase of suction the front piezoelectric clamp section 5 turns to its free state. At the same time the rear piezoelectric clamp section 3 turns into the clamped state starting to press on the housing 1 from inside.

In the fourth phase of the suction the piezoelectric extender section 4 under force of the compressing rod 16 turns into the free state, that is, reduces its length. The front piezoelectric clamp section 5 moves backward for a short distance.

Such a phases sequence is repeated at suction many times until the fluid displacer 24 (piston 28) reaches its extreme rear position. The moment when the extreme rear position is reached is determined from curve of the electric current changing in the wire 39. Also this moment can be monitored by means of piezoelectric sections position feedback sensor or a displacer position feedback sensor (not shown in the drawings).

As the piston 28 is connected to the moving piezo anchor 2, pumped fluid is sucked in due to movement of the piston 28, filling the space between the piston 28 and the housing of the displacer 22. The intake valve 35 is opened and the outlet valve 36 is closed.

The elastic member 37 due to its elasticity and damping properties reduces vibration waves generated at movement of the piezo anchor 2 and transmitted to the piston 28. It decreases possibility of pumped fluid cavitation, as well as longitudinal vibration of the unit.

The claimed piezoelectric pump unit is industrially applicable in transport and industry for pumping fluids of high pressure and relatively low supply in the most successful way, where usage of other types of pumps is hardly possible due to dimensions, weight and effectiveness.

The invention claimed is:

1. A piezoelectric pump unit, comprising:

a housing-having an imaginary longitudinal axis, the housing containing:

a piezo anchor, a fluid displacer of pumped fluid, located in the front of the housing, the piezo anchor and the fluid displacer are coupled, the piezo anchor containing:

a rear piezoelectric clamp section including: a first U-shaped bracket and a first piezoelectric stack within the first U-shaped bracket, the direction of the first piezoelectric stack length variation in response to being supplied with electrical voltage is transverse of the imaginary longitudinal axis, the first piezoelectric stack being configured to cause the first U-shaped bracket to press the housing from inside thereof in a direction transverse of the imaginary longitudinal axis, a piezoelectric extender section that is movable relative to the housing along the imaginary longitudinal axis, a front piezoelectric clamp section including: a second U-shaped bracket and a second piezoelectric stack within the second U-shaped bracket, the direction of the second piezoelectric stack length variation in response to being supplied with electrical voltage is aligned with the direction of the first piezoelectric stack length variation in response to being supplied with electrical voltage, the second piezoelectric stack being configured to cause the second U-shaped bracket to press the housing from inside thereof in a direction aligned with the direction of the first piezoelectric stack pressing the housing from inside thereof, and the rear piezoelectric clamp section, the piezoelectric extender section and the front piezoelectric clamp section being connected in series along the imaginary longitudinal axis, wherein at least one slider is introduced in the piezoelectric extender section between the rear piezoelectric clamp section and the front piezoelectric clamp section, the slider contacts the housing from inside, and the housing comprises two friction members and two lateral members; the friction members are arranged parallel, one member is opposite another member; the lateral members are attached between them forming an internal space, the piezo anchor is located in the internal space; the longitudinal bars of the first U-shaped bracket and the second U-shaped bracket abut the friction members.

2. The piezoelectric pump unit according to claim 1, wherein the first U-shaped bracket is composed of two longitudinal bars and a transverse bar connecting them; the first piezoelectric stack is located between the longitudinal bars of the first U-shaped bracket; the direction of the first piezoelectric stack length variation in response to being supplied with electrical voltage is transverse of the longitudinal bars of the first U-shaped bracket;

the second U-shaped bracket is composed of two longitudinal bars and a transverse bar connecting them; the second piezoelectric stack is located between the longitudinal bars of the second U-shaped bracket; the direction of the second piezoelectric stack length variation in response to being supplied with electrical voltage is transverse of the longitudinal bars of the second U-shaped bracket;

the transverse bar of the first U-shaped bracket faces forward, the transverse bar of the second U-shaped bracket faces backward, the rear end of the piezoelectric extender section is coupled to the transverse bar of the first U-shaped bracket, the front end of the piezoelectric extender section is coupled to the transverse bar of the second U-shaped bracket;

the longitudinal bars of the first and second U-shaped brackets are parallel.

* * * * *